US007128151B2

(12) United States Patent
Corbett

(10) Patent No.: US 7,128,151 B2
(45) **Date of Patent: *Oct. 31, 2006**

(54) GRAVEL PACK CROSSOVER TOOL WITH SINGLE POSITION MULTI-FUNCTION CAPABILITY

(75) Inventor: Thomas G. Corbett, Willis, TX (US)

(73) Assignee: Baker Hughes Incorporated, Houston, TX (US)

( * ) Notice: Subject to any disclaimer, the term of this patent is extended or adjusted under 35 U.S.C. 154(b) by 100 days.

This patent is subject to a terminal disclaimer.

(21) Appl. No.: 10/715,779

(22) Filed: Nov. 17, 2003

(65) Prior Publication Data

US 2005/0103495 A1 May 19, 2005

(51) Int. Cl.
*E21B 43/04* (2006.01)

(52) U.S. Cl. ..... 166/278; 166/276

(58) Field of Classification Search ..... 166/278, 166/51, 305.1, 381, 386, 387, 316, 318, 325, 166/329, 332.8
See application file for complete search history.

(56) References Cited

U.S. PATENT DOCUMENTS

| | | | | | |
|---|---|---|---|---|---|
| 3,441,084 | A | | 4/1969 | Fredd | |
| 3,554,281 | A | | 1/1971 | Ecuer | |
| 3,850,246 | A | * | 11/1974 | Despujols | 166/278 |
| 3,913,676 | A | * | 10/1975 | Barbee et al. | 166/278 |
| 3,963,076 | A | * | 6/1976 | Winslow | 166/278 |
| 3,987,854 | A | * | 10/1976 | Callihan et al. | 166/278 |
| 4,420,041 | A | | 12/1983 | Patel | |
| 4,541,484 | A | | 9/1985 | Salerni et al. | |
| 4,633,943 | A | * | 1/1987 | Zunkel | 166/51 |
| 4,633,944 | A | * | 1/1987 | Zunkel et al. | 166/51 |
| 4,635,716 | A | * | 1/1987 | Zunkel | 166/51 |
| 4,858,690 | A | * | 8/1989 | Rebardi et al. | 166/278 |
| 5,443,117 | A | | 8/1995 | Ross | |
| 5,597,040 | A | * | 1/1997 | Stout et al. | 166/51 |
| 5,609,204 | A | | 3/1997 | Rebardi et al. | |
| 5,620,050 | A | | 4/1997 | Barbee | |
| 5,865,251 | A | | 2/1999 | Rebardi et al. | |
| 6,065,535 | A | | 5/2000 | Ross | |
| 6,148,915 | A | | 11/2000 | Mullen et al. | |
| 6,464,006 | B1 | | 10/2002 | Womble | |
| 6,702,020 | B1 | * | 3/2004 | Zachman et al. | 166/278 |

(Continued)

OTHER PUBLICATIONS

OSCA, "Multi-Position Set-Down Service Tool," Technical Bulletin, 1 page, 2000.

*Primary Examiner*—Frank S. Tsay
(74) *Attorney, Agent, or Firm*—Steve Rosenblatt

(57) ABSTRACT

A gravel packing method and apparatus allows setting the packer by dropping a ball to a seat that it isolated from the effects of formation pressures when trying to set the packer. This is accomplished by isolation of the gravel pack outlet port when setting the packer and locating the ball seat in a position where the effects of formation pressure are irrelevant. Additionally, by positioning the evacuation ports above a seal bore in the screen extension during circulation or squeeze to deposit gravel and further putting check valves in the evacuation ports, the evacuation step after circulation or squeeze can be accomplished without having to reposition the crossover. The crossover is supported from the packer and movement of the crossover away and back to the support from the packer operates a valve to allow squeezing when the valve is closed and circulating and reversing out when the valve is open. Thus, the gravel pack method and apparatus facilitates circulation, squeeze and reverse circulation in a single supported position.

15 Claims, 3 Drawing Sheets

U.S. PATENT DOCUMENTS

2002/0096328 A1* 7/2002 Echols et al. ..... 166/278
2003/0188866 A1* 10/2003 Bissonnette et al. ..... 166/278
2003/0192694 A1* 10/2003 Zachman et al. ..... 166/278

* cited by examiner

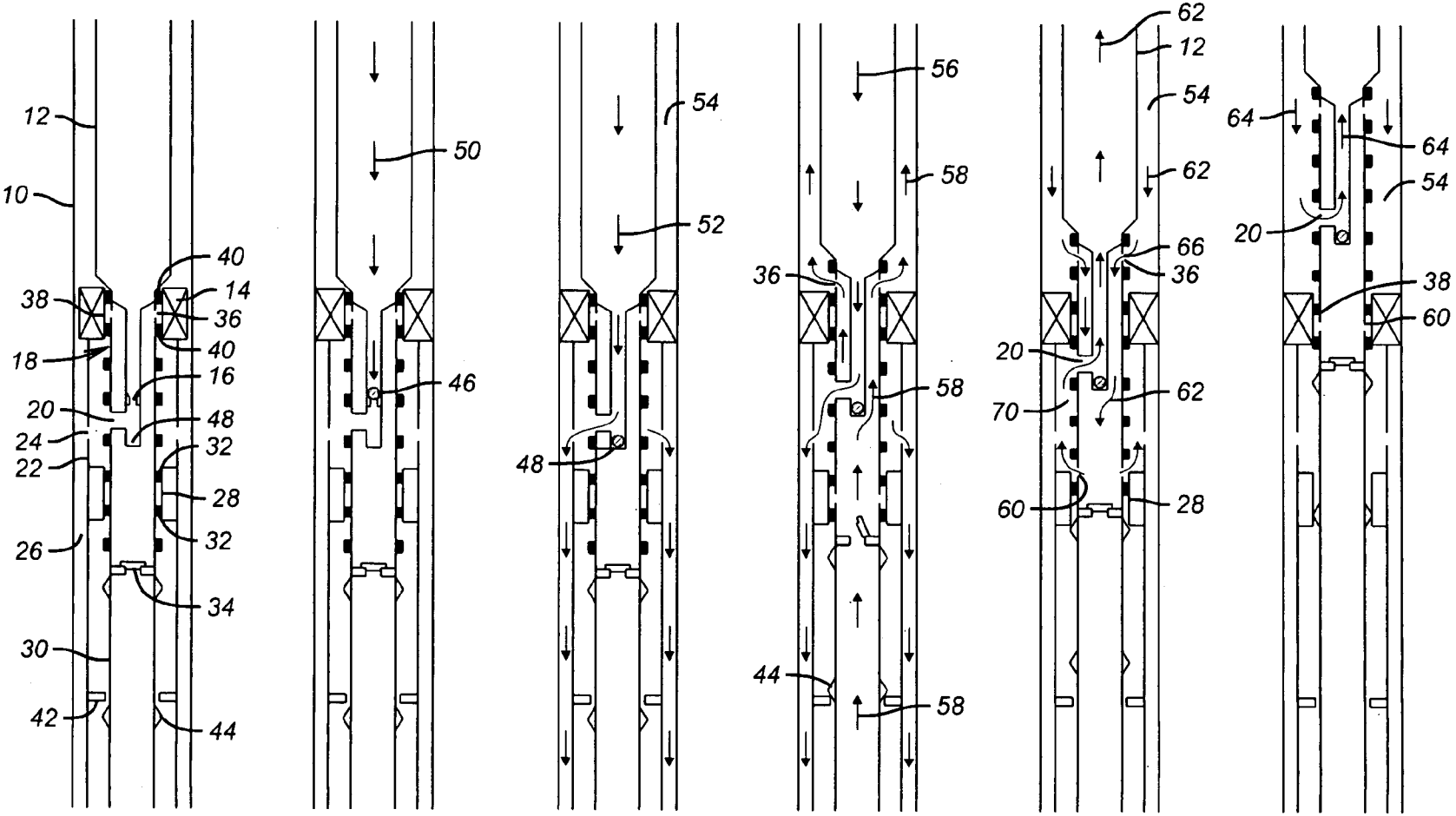
(PRIOR ART) FIG. 1
(PRIOR ART) FIG. 2
(PRIOR ART) FIG. 3
(PRIOR ART) FIG. 4
(PRIOR ART) FIG. 5
(PRIOR ART) FIG. 6

GRAVEL PACK CROSSOVER TOOL WITH SINGLE POSITION MULTI-FUNCTION CAPABILITY

FIELD OF THE INVENTION

The field of this invention is crossover tools for gravel packing a screen downhole and more particularly to crossover tools that permit the squeezing, circulating and reversing out with the tool in the same position with respect to a downhole packer.

BACKGROUND OF THE INVENTION

FIGS. 1–6 illustrate the prior art crossover tool in a typical gravel packing operation. The wellbore 10 receives a running string and setting tool shown schematically as 12. A packer 14 sealingly accepts the string and setting tool 12. A ball seat 16 is located in the crossover tool 18 just above gravel pack port 20. Screen extension 22 is attached to packer 14 and has ports 24 to permit gravel access to annulus 26. Screen extension 22 has a seal bore 28 through which a wash pipe 30 extends in sealing contact for run in, shown in FIG. 1, due to contact of seals 32. A flapper 34 allows uphole flow in wash pipe 30 and prevents downhole flow. Return ports 36 are in the seal bore 38 of the packer 14 and are closed due to the position of seals 40 that straddle return ports 36 in seal bore 38. Screen extension 22 has a support surface 42 that can engage tabs 44 to pinpoint the circulation position of FIG. 4.

To set the packer 14, the assembly is run into position, as shown in FIG. 1 and a ball 46 is dropped onto ball seat 16. Ultimately, after the packer is set, the ball 46 is blown through ball seat 16 or the ball and the seat move together after a shear pin (not shown) is broken and the assembly lands in recess 48 (see FIG. 3). One of the problems with this layout is that if the formation is under sub-hydrostatic pressure, such sub-hydrostatic pressure communicates with the underside of ball 46 on seat 16 and limits the amount of pressure that can be applied from above, shown schematically as arrows 50, before breaking a shear pin on the ball seat 16. This can reduce the available pressure to set the packer 14 because the sub-hydrostatic pressure on the underside of ball 46 acts equivalently to applied pressure from above, represented by arrows 50. Yet another drawback of this arrangement is that when the packer 14 makes contact with the wellbore 10 and the passage through its seal bore 38 is obstructed, the liquid column above the packer 14 can no longer exert pressure on the formation. This can result in portions of the formation breaking off into the wellbore and potentially obstructing it. The present invention addresses these problems by repositioning the ball seat 16' and insuring that the seal bore 38' is not closed by the crossover tool 18' during setting of the packer.

Continuing now with the prior technique, after the packer 14 is set, the ball 46 and the seat 16 are blown into recess 48. The set of the packer can be tested by applying pressure to annulus 54. Furthermore, gravel slurry or fluid represented by arrows 52 can be squeezed into the formation adjacent to the screens (not shown) as illustrated in FIG. 3. The fluid represented by arrow 52 flows through the crossover tool 18 to exit the gravel pack port 20 and then flows through ports 24 in screen extension 22 into the annulus 26 around the outside of the screens (not shown). Returns are blocked off because the return ports 36 are sealingly positioned in seal bore 38 of the packer 14 by virtue of straddle seals 40. Any leakage past packer 14 will be seen as a pressure rise in annulus 54.

The next step is circulation, shown in FIG. 4. Here the gravel slurry represented by arrows 56 passes through the crossover 18 through gravel pack ports 20. It then passes through ports 24 in screen extension 22 and into the annulus 26. The gravel remains behind in annulus 26 around the screens (not shown) and the carrier fluid, represented by arrows 58, passes through the screens and opens flapper 34. It should be noted that the crossover tool 18 has been raised slightly for this operation to expose return ports 36 into annulus 54 above packer 14. The carrier fluid 58 passes the flapper 34 and exits the return ports 36 and goes to the surface through annulus 54. Lug 44 rests on support surface 42 to allow the crew at the surface to know that the proper position for circulation has been reached.

In the next step, called evacuation, the excess gravel that is in the annulus 70 between the screen extension 22 and the crossover tool 18 needs to be reversed out so that the crossover tool 18 will not stick in the packer seal bore 38 when the crossover tool 18 is lifted out. To do this, the crossover tool 18 has to be lifted just enough to get the evacuation ports 60 out of seal bore 28. Evacuation flow, represented by arrows 62 enters return ports 36 and is stopped by closed flapper 34. The only exit is evacuation ports 60 and back into gravel pack port 20 and back to the surface through the string and setting tool 12. The problem here is that the intermediate position for reversing gravel out from below the packer 14 is difficult to find from the surface. Due to the string 12 being long and loaded with gravel at this point, the string is subject to stretch. The surface personnel for that reason are prone to wittingly or unwittingly skip this step and pull the crossover tool 18 up too high into the alternate reverse position shown in FIG. 6. In the FIG. 6 position, the evacuation ports 60 are closed in seal bore 38 of packer 14 and gravel pack port 20 is now above packer 14 in annulus 54. Arrows 64 show how the reversing flow clears out the string 12 above packer 14.

The problem with skipping the evacuation step is that the excess gravel in the annulus 70 below packer 14 may cause the crossover tool 18 to stick in seal bore 38 as the crossover tool 18 is raised to accomplish the reverse step shown in FIG. 6 or later when crossover tool 18 removal is attempted. The present invention allows the evacuation step to occur without having to reposition the crossover tool 18 with respect to the packer 14. This is accomplished by the addition of check valves 66 in relocated evacuation ports 60'. Additionally, the steps of squeezing, circulating and reversing out can be accomplished with the tool in the same position of support from the packer 14'. The present invention will be more readily appreciated by those skilled in the art from a review of the description of the preferred embodiment and the claims that appear below.

SUMMARY OF THE INVENTION

A gravel packing method and apparatus are described where to set the packer; a ball is dropped to a seat that it isolated from the effects of formation pressures when trying to set the packer. This is accomplished by isolation of the gravel pack outlet port when setting the packer and locating the ball seat in a position where the effects of formation pressure are irrelevant. Additionally, by positioning the evacuation ports above a seal bore in the screen extension during circulation to deposit gravel and further putting check valves in the evacuation ports, the evacuation step after circulation can be accomplished without having to reposition the crossover. The crossover tool is supported from the packer and movement of the crossover tool away and back to the support from the packer operates a valve to allow squeezing when the valve is closed and circulating and reversing out when the valve is open.

BRIEF DESCRIPTION OF THE DRAWINGS

FIG. 1 is the run in position of the prior art method of gravel packing;

FIG. 2 is the view of FIG. 1 in the packer setting position;

FIG. 3 is the view of FIG. 2 in the packer test and squeeze position

FIG. 4 is the view of FIG. 3 in the circulate to deposit gravel position;

FIG. 5 is the view of FIG. 4 in the evacuation position;

FIG. 6 is the view of FIG. 5 in the alternate reverse position;

DETAILED DESCRIPTION OF THE PREFERRED EMBODIMENT

Figure 10:
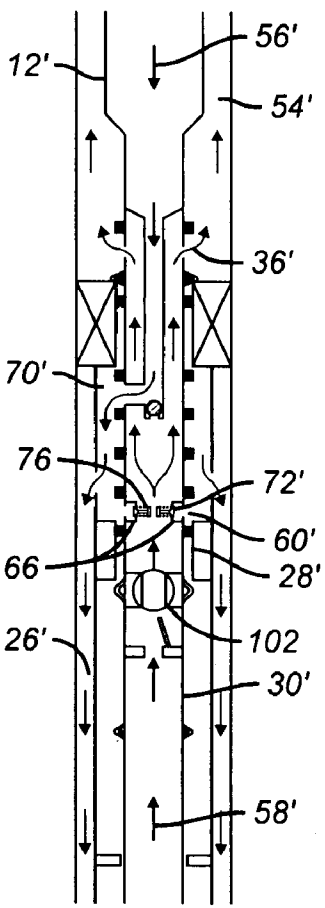
FIG. 10 is the view of FIG. 7 in the circulate to deposit gravel position.
Figure 8:
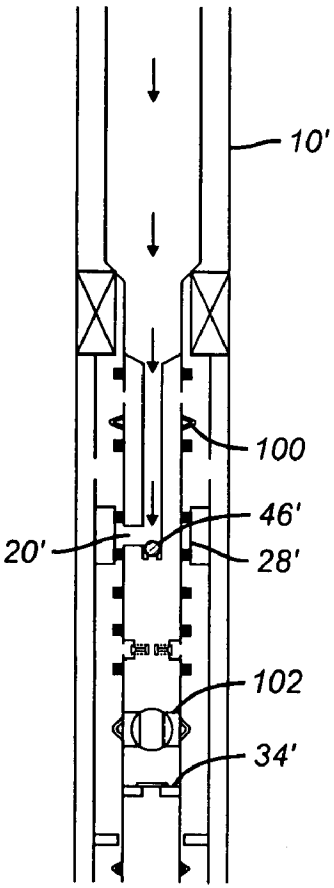
FIG. 8 is the view of FIG. 7 in the packer set position.
Figure 7:
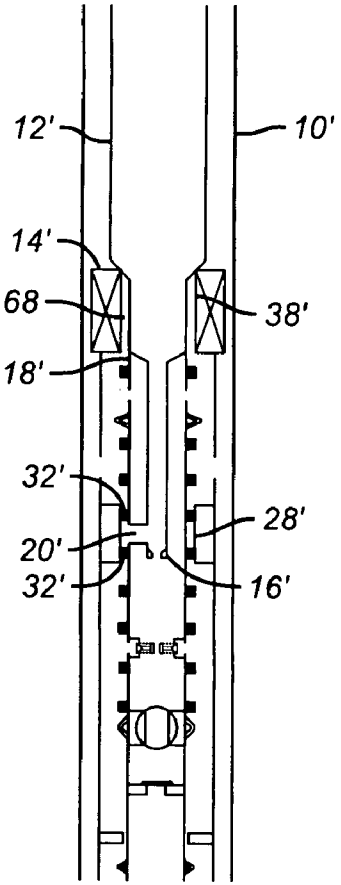
FIG. 7 is the present invention in the run in position.

In the run in position of FIG. 7, the seal bore 38' has a clearance 68 around the crossover tool 18'. The ball seat 16' is located below gravel pack port 20'. During run in and setting of the packer 14', the gravel pack port 20' is sealed in seal bore 28' by virtue of seals 32'. As shown in FIG. 8, when the ball 46' lands on seat 16' it will not go any lower. Thus exposure to sub-hydrostatic formation pressures below ball 46' will not affect the setting of packer 14'. This is because there is no longer any need to shear out the seat 16' due to its location below gravel pack port 20'. An upward shift of the crossover tool 18' will position gravel pack port 20' out and above seal bore 28', as illustrated in FIG. 10, so that gravel slurry 56' can be pumped down string 12' and into annulus 26' with returns 58' coming through flapper 34' and into annulus 54' by way of return ports 36'. It should be noted that during circulation, the evacuation ports 60' are above the seal bore 28' but internal pressure in wash pipe 30' is prevented from exiting the wash pipe 30' through the evacuation ports 60' by the presence of check valves 66. This is because the pressure in annular space 70' exceeds the pressure within the wash pipe 30' forcing the valve member 72 against its seat 74 with the assistance of spring 76.

Figure 11:
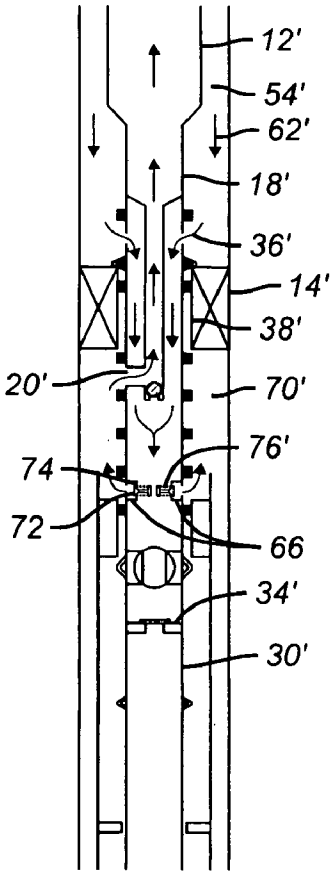
FIG. 11 is the view of FIG. 10 in the evacuation position.

The evacuation step shown in FIG. 11 can be accomplished without having to raise the crossover tool 18'. Instead, the reverse flow indicated by arrows 62' goes down annulus 54', through return ports 36', and out through check valves 66. This time the pressure inside wash pipe 30' is greater than the pressure in annular space 70' and the valve members 72 are pushed against the bias of springs 76 to move away from their respective seats 74. The flow continues to gravel pack ports 20' and up to the surface through the string 12'. The fact that the position of the crossover tool 18' does not need to be changed after the circulation of the gravel into position, insures that the evacuation step will actually be executed. Insuring that the evacuation step is accomplished minimizes if not eliminates the risk of sticking the crossover tool 18' in the seal bore 38' of packer 14' due to remaining gravel in the annulus 70' below the packer 14' as the crossover tool 18' is being lifted for the reverse step of FIG. 13 or during its total removal at the conclusion of the gravel packing operation.

Those skilled in the art will readily appreciate the advantages of the present invention. First, since the ball seat 16' is never sheared out after setting the packer 14' because the ball seat 16' is already below the gravel pack outlet 20', the effects of sub-hydrostatic formation pressure on the packer setting operation go away. This is because there is no shear pin to break prematurely before the packer 14' is set due to sub-hydrostatic pressure on the underside of a seated ball 46', as can be seen in FIG. 8.

The packer bore 38' has a clearance around the crossover tool 18' when the packer is set. Thus, the liquid column to the surface is always acting on the formation even as the packer makes contact with the wellbore 10'. Having this column of fluid to exert pressure on the formation prevents cave-in of the wellbore as the pressure prevents pieces of the formation from breaking off into the wellbore.

The crossover tool 18' does not need to be moved between circulation shown in FIG. 10 and evacuation, shown in FIG. 11. This insures proper removal of gravel from annulus 70' before trying to move the crossover tool 18'. The chance of sticking the crossover tool 18' in the seal bore 38' is reduced if not eliminated.

Figure 9:
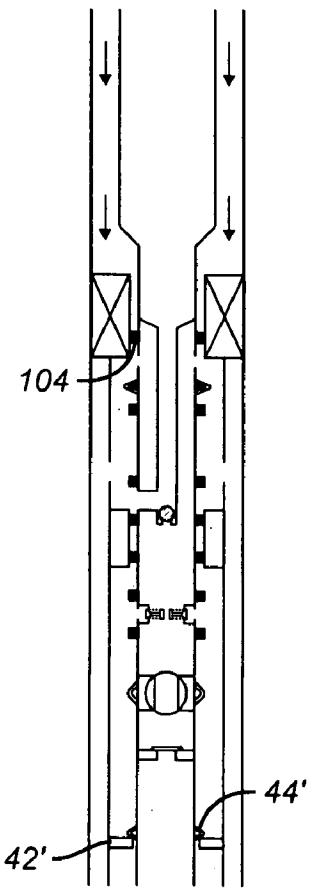
FIG. 9 shows the packer test position.
Figure 12:
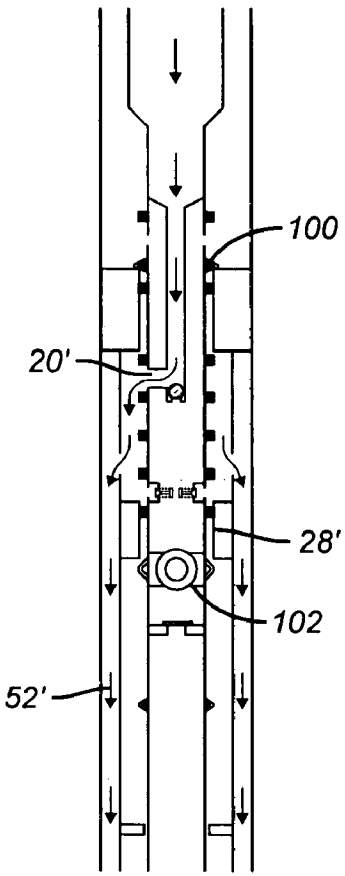
FIG. 12 is the view of FIG. 7 in the squeeze position.

In the packer setting position of FIG. 8, the gravel pack ports 20' are sealed in seal bore 28'. To test the set packer, the crossover tool 18' is lifted slightly to expose the gravel pack port 20' and to put seal 104 into seal bore 38' of the packer 14'. Seal 104 isolates return ports 36' from above and the set of packer 14' can be tested by applying pressure to annulus 54'. This position is shown in FIG. 9 and is obtained when collet support 44' lands on support 42'. To get from the test packer position of FIG. 9 to the circulate position of FIG. 10, the crossover tool 18' is raised to get the collapsible supports 100 through seal bore 38' so that they become supported on the packer 14' as shown in FIG. 10. The act of raising the crossover tool 18'works to operate valve 102 from the open position of FIG. 10 to the closed position in FIG. 13. Squeezing can now occur as the closed valve 102 prevents the pumped fluid 52' from returning through the wash pipe 30'. Valve 102 can be one of a variety of designs such as a ball, a plug, or a sliding sleeve, to mention a few examples. The operating mechanism for valve 102 can be a j-slot or other known techniques responsive to movement. Once in the FIG. 12 position for a squeeze job, the crossover can be placed into the circulate position by simply picking up supports 100 off of packer 14' and setting right back down again to the same position. The up and back down movement results in opening of valve 102 as shown in FIG. 10. Circulation is now possible as returns open flapper 34' and flow through valve 102 and through the crossover and out to ports 36' and up to the surface through annulus 54'. In the reverse operation, without movement of the crossover tool 18' flow 62' enters ports 36' and pushes open check valves 66 because no flow can go through the flapper 34'. As a result the flow enters annulus 70' and cleans it out on the way back uphole through the tubing 12'. After this reverse operation is accomplished, the crossover tool is picked up to close valve 102 while getting ports 20' above seal bore 38' while check valves 66 are effectively isolated in seal bore 38'. In this position flow down annulus 54' goes through ports 20' to take any residual gravel to the surface through the tubing 12'. Closing valve 102 is not mandatory but can happen coincidentally because the crossover 18' is lifted to the FIG. 13 position. Additionally, in the FIG. 13 position, the check valves 66 can be in the seal bore 38' or above it.

Figure 13:
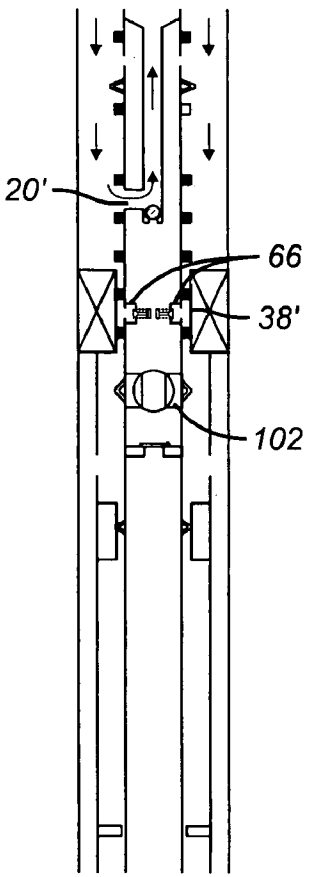
FIG. 13 is the view of FIG. 11 in the alternate reverse position.

Those skilled in the art will appreciate that the tool of the present invention allows the crossover tool 18' to remain in the same position with ports 36' in fluid communication with annulus 54' above the packer 14' while the squeeze operation takes place. Then by shifting the crossover tool 18' up and down to the same position as it was in during the squeezing operation, the circulating for gravel deposition can take place as well as reversing out. The initial reversing out requires no movement of the crossover tool 18'. The initial reversing out occurs with gravel outlet 20' still below the seal bore 38' in the packer 14' and allows a thorough removal of any remaining gravel in annulus 70' before any attempt is made to pick up the crossover tool 18'. Doing the initial reverse, as shown in FIG. 11, removes or minimizes the risk of sticking the crossover tool 18' in the seal bore 38'. It is only after the annular space 70' is reversed out that the crossover tool 18' is picked up to get the gravel outlets 20' above the packer 14' for what is shown in FIG. 13 as the alternate reverse step. The alternate reverse step in FIG. 13 is optional in that the entire contents of tubing 12' can be reverse circulated out of the well in the reverse position as shown in FIG. 11. It should be noted that shifting the crossover tool up and then back down after a squeeze operation shown in FIG. 12 results in opening of valve 102 to make circulation possible. Alternatively, valve 102 can be run in open if there is no squeeze step called for in the completion plan. Returns are possible in the circulation mode of FIG. 10 because valve 102 is open and flow up the wash pipe 30' opens the flapper 34'. On the other hand, when the flow direction is reversed after circulation and deposition of the gravel, flow down the wash pipe 30' is stopped by flapper 34' and check valves 66 let flow pass into annular space 70' to return to the surface through gravel ports 20' and then through tubing 12'.

The foregoing disclosure and description of the invention are illustrative and explanatory thereof, and various changes in the size, shape and materials, as well as in the details of the illustrated construction, may be made without departing from the spirit of the invention.

I claim:

1. A gravel packing method, comprising:

running in a packer and a screen assembly;

inserting an assembly of a crossover that supports a wash pipe at least in part into said packer;

providing a seat on said crossover to accept an obstructing object for setting the packer said seat immovably secured to said crossover in a manner that it and the obstructing object cannot be moved upon application of pressure at least as high as needed to set the packer, building pressure on the seat and the obstructing object to a predetermined level sufficient to set the packer without any effect from downhole pressure acting below the object on the seat.

2. The method of claim 1, comprising:

providing at least one gravel outlet port in said crossover;

selectively obstructing said gravel outlet port from downhole pressure when setting said packer.

3. The method of claim 2, comprising:

locating said seat further downhole on said crossover than said gravel outlet port.

4. The method of claim 1, comprising:

providing a clearance in the bore of the packer as it is set;

allowing a fluid column to act through said clearance during setting of the packer to exert pressure on the formation below the packer for resisting cave-ins into the wellbore.

5. A gravel packing method, comprising:

running in a packer and a screen assembly;

inserting an assembly of a crossover that supports a wash pipe at least in part into said packer;

moving said crossover from a first position for setting the packer to a second position after said packer is set to deposit gravel with there being no operating positions of the crossover between said first and second positions, depositing gravel outside said screen using circulation through said crossover;

reversing excess gravel without moving the crossover from its position during deposition of gravel after said depositing by flowing fluid in a direction opposite to that during said depositing but isolating said reverse flow from passing through said screen.

6. The method of claim 5, comprising:

supporting said crossover in said second position so that ports are open to provide fluid communication, in a first path, between inside said wash pipe and an annular space above said packer.

7. The method of claim 6, comprising:

supporting said crossover in said second position so that gravel ports are open to provide fluid communication, in a second path, through said crossover and to an annular space between said wash pipe and said screen and out to the outside of said screen where gravel may be deposited.

8. The method of claim 7, comprising:

providing unidirectional flow access, with a first check valve, from inside said wash pipe to said annular space between said wash pipe and said screen to facilitate said reversing.

9. The method of claim 8, comprising:

preventing flow down said wash pipe toward said screen with a second check valve that permits flow through said wash pipe coming from within said screen.

10. The method of claim 6, comprising:

providing a shutoff valve in said wash pipe to selectively close it while said crossover is in said second position and said shutoff valve is in a closed position;

performing a squeeze operation with said shutoff valve in said closed position.

11. A gravel packing method, comprising:

running in a packer and a screen assembly;

inserting an assembly of a crossover that supports a wash pipe at least in part into said packer;

moving said crossover from a first position for setting the packer to a second position after said packer is set, depositing gravel outside said screen using circulation through said crossover, when said crossover is in said second position, maintaining said second position of said crossover after said depositing;

reversing excess gravel after said depositing by flowing fluid in a direction opposite to that during said depositing but isolating said reverse flow from passing through said screen;

supporting said crossover in said second position so that ports are open to provide fluid communication, in a first path, between inside said wash pipe and an annular space above said packer;

providing a shutoff valve in said wash pipe to selectively close it while said crossover is in said second position and said shutoff valve is in a closed position;

raising said crossover from said second position and lowering it back to said second position to open said shutoff valve to facilitate circulation.

12. The method of claim 11, comprising:

raising said crossover from said second position until a gravel outlet is above the packer;

closing said shutoff valve by said raising;

reverse flowing fluid into said gravel outlet to remove gravel to the surface through tubing connected to said crossover.

13. A gravel packing method, comprising:

running in a packer and a screen assembly;

inserting an assembly of a crossover that supports a wash pipe at least in part into said packer;

moving said crossover from a first position for setting the packer to a second position after said packer is set, depositing gravel outside said screen using circulation through said crossover, when said crossover is in said second position, maintaining said second position of said crossover after said depositing;

reversing excess gravel after said depositing by flowing fluid in a direction opposite to that during said depositing but isolating said reverse flow from passing through said screen;

supporting said crossover in said second position so that ports are open to provide fluid communication, in a first path, between inside said wash pipe and an annular space above said packer;

supporting said crossover in said second position so that gravel ports are open to provide fluid communication, in a second path, through said crossover and to an annular space between said wash pipe and said screen and out to the outside of said screen where gravel may be deposited;

providing unidirectional flow access, with a first check valve, from inside said wash pipe to said annular space between said wash pipe and said screen to facilitate said reversing;

preventing flow down said wash pipe toward said screen with a second check valve that permits flow through said wash pipe coming from within said screen;

providing a shutoff valve in said wash pipe to selectively close it while said crossover is in said second position;

performing a squeeze operation with said shutoff valve in said closed position.

14. A gravel packing method, comprising:

running in a packer and a screen assembly;

inserting an assembly of a crossover that supports a wash pipe at least in part into said packer;

moving said crossover from a first position for setting the packer to a second position after said packer is set, depositing gravel outside said screen using circulation through said crossover, when said crossover is in said second position, maintaining said second position of said crossover after said depositing;

reversing excess gravel after said depositing by flowing fluid in a direction opposite to that during said depositing but isolating said reverse flow from passing through said screen;

supporting said crossover in said second position so that ports are open to provide fluid communication, in a first path, between inside said wash pipe and an annular space above said packer;

supporting said crossover in said second position so that gravel ports are open to provide fluid communication, in a second path, through said crossover and to an annular space between said wash pipe and said screen and out to the outside of said screen where gravel may be deposited;

providing unidirectional flow access, with a first check valve, from inside said wash pipe to said annular space between said wash pipe and said screen to facilitate said reversing;

preventing flow down said wash pipe toward said screen with a second check valve that permits flow through said wash pipe coming from within said screen;

providing a shutoff valve in said wash pipe to selectively close it while said crossover is in said second position;

performing a squeeze operation with said shutoff valve in said closed position;

raising said crossover from said second position and lowering it back to said second position to open said shutoff valve to facilitate circulation.

15. The method of claim 14, comprising:

raising said crossover from said second position until a gravel outlet is above the packer;

closing said shutoff valve by said raising;

reverse flowing fluid into said gravel outlet to remove gravel to the surface through tubing connected to said crossover.

* * * * *